US009784539B1

(12) United States Patent
Preuss

(10) Patent No.: US 9,784,539 B1
(45) Date of Patent: Oct. 10, 2017

(54) REACTIVE TARGET RETENTION DEVICES

(71) Applicant: Patrick A. Preuss, Milwaukee, WI (US)

(72) Inventor: Patrick A. Preuss, Milwaukee, WI (US)

( * ) Notice: Subject to any disclaimer, the term of this patent is extended or adjusted under 35 U.S.C. 154(b) by 0 days.

(21) Appl. No.: 15/146,938

(22) Filed: May 5, 2016

Related U.S. Application Data

(60) Provisional application No. 62/180,651, filed on Jun. 17, 2015.

(51) Int. Cl.
*F41J 1/10* (2006.01)
*F41J 9/16* (2006.01)

(52) U.S. Cl.
CPC .. *F41J 1/10* (2013.01); *F41J 9/16* (2013.01)

(58) Field of Classification Search
CPC ..... A47F 7/143; F41J 1/10; G09F 7/18
USPC ..... 273/380, 407; 446/362, 314, 315; 473/568; 40/617, 623, 647, 648, 657, 40/658, 777, 661.05, 124.2, 124.4, 791, 40/661.08
See application file for complete search history.

(56) References Cited

U.S. PATENT DOCUMENTS 1,723,826 A * 8/1929 Van Auken ..... F41J 5/18 273/380
2,532,132 A * 11/1950 Vogel ..... A47F 7/143 40/124.4
3,431,667 A * 3/1969 Woods ..... G03B 42/042 40/710
5,280,920 A * 1/1994 Knapper, II ..... F41J 1/10 273/407
5,301,871 A * 4/1994 Gross ..... A47G 19/065 206/562
5,987,791 A * 11/1999 Paine ..... G09F 1/10 24/563
6,385,875 B1 * 5/2002 Santorsola ..... G09F 11/23 116/316
7,422,217 B2 9/2008 Hinnant
8,813,401 B2 8/2014 Diercks
2005/0006848 A1 * 1/2005 Fort, II ..... F41J 1/10 273/407

* cited by examiner

*Primary Examiner* — Mark Graham
(74) *Attorney, Agent, or Firm* — Donald J. Ersler

(57) ABSTRACT

A reactive target retention device preferably includes a flat sheet with at least one cutout pattern. The cutout pattern includes a target opening, two opposing tabs and an inner tab is formed in each opposing tab. An alternative reactive target retention device preferably includes a flat sheet with at least one cutout pattern. The cutout pattern includes a target opening, at least two partial cutouts and at least two projection tabs. A final reactive target retention device includes a flat sheet, a target opening and at least two retention clips. A target sheet support device includes a pair of post members and two horizontal support members. An alternative target sheet support device includes the pair of post members and at least one horizontal support wire. Another target sheet support device includes flat sheet having an outer shape of an animal and a pair of support posts.

9 Claims, 13 Drawing Sheets

REACTIVE TARGET RETENTION DEVICES

CROSS-REFERENCES TO RELATED APPLICATIONS

This is a utility patent application taking priority from provisional application No. 62/180,651 filed on Jun. 17, 2015.

BACKGROUND OF THE INVENTION

Field of the Invention

The present invention relates generally to sport shooting and more specifically to reactive target retention devices, which more securely retain a reactive target in a target display.

Discussion of the Prior Art

Shooting is a popular sport. Targets are used for various purposes including for practice, competition, and sighting weapons. One problem is that targets have a limited life. This problem has been addressed with many devices and methods to provide extended life or expedited replacement. A popular type of target or reactive target used for both moving and stationary target shooting is the clay disk target, common names also include: clay pigeon, sporting clay, trap, skeet, or flyer targets. These targets are used mainly for their price, economy and availability. Current protected inventions and inventions in the public domain use a variety of tabs, clips, other fastener methods, and friction fit in a sheet material to hold reactive targets. Another problem is the securement of the attachment of the reactive target in the many devices and methods of retaining reactive targets. Weather factors such as rain, snow, or wind can dislodge targets before the shooter has a chance to shoot the reactive target. Bullet impacts on the target material around the reactive target or impacts to the target stand can also dislodge the target before the shooter is able to place additional shots in the target. The inconsistent holding methods also limit the ability of the target product to be used in a competition environment since the security of the target cannot be guaranteed to present a target in all conditions to the competitive shooter.

Another problem is that the current prior art limits the orientation of the targets to a specific orientation relative to tabs, when tabs have been used. The tabs in current prior art must be horizontal to act as a shelf for the reactive targets to rest on top. If the target is rotated with the tabs vertical, the reactive targets easily becomes dislodged and falls to the ground. The delicate nature of the reactive targets usually results in breakage when falling and lost time for the shooter to reset new reactive targets. Permanent securement with screws, staples, and nails is mainly used to overcome these issues. The delicate nature of the reactive target limits the methods of attachment to avoid breakage, before the shooter can shoot the target. It also requires the shooter to carry additional equipment and supplies to participate in the shooting activities. What is needed are improved devices for securing reactive targets to a display, which can be done in a reliable, secure, quick manner, and without the requirement of additional fasteners to achieve securement.

U.S. Pat. No. 7,422,217 to Hinnant discloses a target assembly for holding clay targets. U.S. Pat. No. 8,770,587 to Diercks discloses a multi-purpose reversible target, stand, and display.

Accordingly, there is a clearly felt need in the art for reactive target retention devices, which more securely retain a reactive target in a target display than that of the prior art.

SUMMARY OF THE INVENTION

The present invention provides reactive target retention devices, which more securely retain a reactive target in a target display. The reactive target retention device preferably includes a flat sheet with at least one cutout pattern. The flat sheet is preferably fabricated from plastic, but other materials may also be used. The cutout pattern includes a target opening, two opposing tabs and an inner tab is formed in each opposing tab. The target opening includes two opposing curved portions. A distance between the two opposing curved portions is less than an outer diameter of the reactive target. A tab slit extends from each end of each curved portions at an acute angle from a centerline of the target opening. Distal ends of the two opposing tabs extend into the target opening. Distal ends of the two opposing tabs create a distance, which is less than a diameter of the reactive target, when in a flat orientation. The inner tab rotates in a direction opposite that of the opposing tab. In use, to retain a reactive target, both opposing tabs are bent to a rear of the flat sheet. The reactive target is inserted past the two opposing tabs, such that a front of the reactive target contacts a rear of the flat sheet. The two inner tabs are bent inward toward each other. The opposing tabs are then bent inward toward each other. The two inner tabs are then bent away from each other, such that they contact a rear of the reactive target. The reactive target device will retain the reactive target in any angular orientation, such as horizontal or vertical.

A second embodiment of the reactive target retention device preferably includes a flat sheet with at least one cutout pattern. The flat sheet is preferably fabricated from plastic, but other materials may also be used. The cutout pattern includes a target opening, at least two partial cutouts and at least two projection tabs. The target opening includes at least two curved portions. An outer perimeter of the at least two curved portions is less than an outer perimeter of the reactive target. Each partial cutout is formed between two adjacent curved portions. An outer perimeter of the at least two cutouts is greater than outer perimeter of the reactive target. Each projection tab includes a base portion, a bridge portion and a retention portion. The base portion extends from the outer perimeter of the partial cutout. The bridge portion extends from a distal end of the base portion. The retention portion extends outward toward the outer perimeter of the partial cutout from a distal end of the bridge portion. In use, to retain a reactive target, the at least two projection tabs are bent to a rear of the flat sheet and perpendicular thereto. The at least two bridge portions are bent outward and down at a junction of the base portion. The reactive target is inserted past the at least two projection tabs, such that a front of the reactive target contacts a rear of the flat sheet. The at least two bridge portions are then bent back toward each other to retain the reactive target. The reactive target device will retain the reactive target in any angular orientation, such as horizontal or vertical.

A third embodiment of the reactive target retention device preferably includes a flat sheet with at least one cutout pattern. The flat sheet is preferably fabricated from plastic, but other materials may also be used. The cutout pattern includes a target opening, at least two partial cutouts and at least two projection tabs. The target opening includes three curved portions. An outer perimeter of the at least two curved portions is less than an outer perimeter of the reactive target. Each partial cutout is formed between two adjacent curved portions. An outer perimeter of the at least two cutouts is greater than an outer perimeter of the reactive target. Each projection tab includes a base portion, a bridge portion, a first retention portion and a second retention portion. The base portion extends from the outer perimeter of the partial cutout. The bridge portion extends from a distal end of the base portion. The first retention portion extends outward toward the outer perimeter of the partial cutout from a first end of the bridge portion. The second retention portion extends outward toward the outer perimeter of the partial cutout from a second end of the bridge portion. In use, to retain a reactive target, the at least two projection tabs are bent to a rear of the flat sheet and perpendicular thereto. The at least two bridge portions are bent outward and down at a junction of the base portion. The reactive target is inserted past the at least two projection tabs, such that a front of the reactive target contacts a rear of the flat sheet. The at least two bridge portions are then bent back toward each other to retain the reactive target. The reactive target retention device will retain the reactive target in any angular orientation, such as horizontal or vertical.

A fourth embodiment of the reactive target retention device includes a plastic molded part. The plastic must have resilient properties with memory. The fourth embodiment of the reactive target retention device includes a flat sheet, a target opening and at least two retention clips. The target opening is formed through the plastic molded sheet and the at least two retention clips extend from a rear of the flat sheet. A diameter of the target opening is less than an outer diameter of the reactive target. Each retention clip includes a base portion and a retention portion. A distance between inside surfaces of the base portions is slightly larger than an outer diameter of the reactive target. The retention portion extends from an inside surface of the base portion. The retention portion includes a support surface and a ramp surface. A distance between the support surface and the flat sheet is slightly more than a thickness of an outer rim of the reactive target. The ramp starts at a distal end of the base portion and ends at an edge of the support surface. In use, to retain a reactive target, a top of the reactive target is pushed into a bottom of the at least two retention clips. The at least two base portions will flex outward to allow an outer diameter of the reactive target to be inserted past the at least two support surfaces. The at least two retention clips will snap back and the reactive target will be captured between a rear of the flat sheet and the at least support surfaces.

The flat sheet may be retained in upright position with a target sheet support device. A first embodiment of the target sheet support device includes a pair of post members and two horizontal support members. One end of a first horizontal support member is attached to a front of a first post member at a top thereof and a second end of a second horizontal support member is attached to a front of a second post member at a top thereof. A second horizontal support member is spaced from the first horizontal support member and attached to the first and second horizontal support members to allow attachment of at least one flat sheet.

A second embodiment of the target sheet support device includes the pair of post members and at least one horizontal support wire. One end of the horizontal support wire is attached to a first post member and a second end of the horizontal support wire is attached to a second post member. The flat sheet includes at least two hooks to hang on the horizontal support wire. A third embodiment of the target sheet support device includes a pair of support pins. The support pins are attached to opposing ends of the flat sheet with any suitable method.

A fourth embodiment of the target sheet support device includes the fourth embodiment of the reactive target retention device and a support post. The support post includes an insertion portion, a ring portion and a support portion. The insertion portion extends downward from a bottom of the ring portion and the support portion extends upward from a top of the ring portion. The insertion portion preferably includes a base insertion portion and two opposed stiffening ribs extending from opposing sides of the base insertion portion. The support portion includes two upper opposed stiffening ribs extending outward from an upper base portion and upward from a top of the ring portion.

Accordingly, it is an object of the present invention to provide reactive target retention devices, which more securely retain a reactive target in a target display than that of the prior art.

These and additional objects, advantages, features and benefits of the present invention will become apparent from the following specification.

DETAILED DESCRIPTION OF THE PREFERRED EMBODIMENTS

Figure 1:
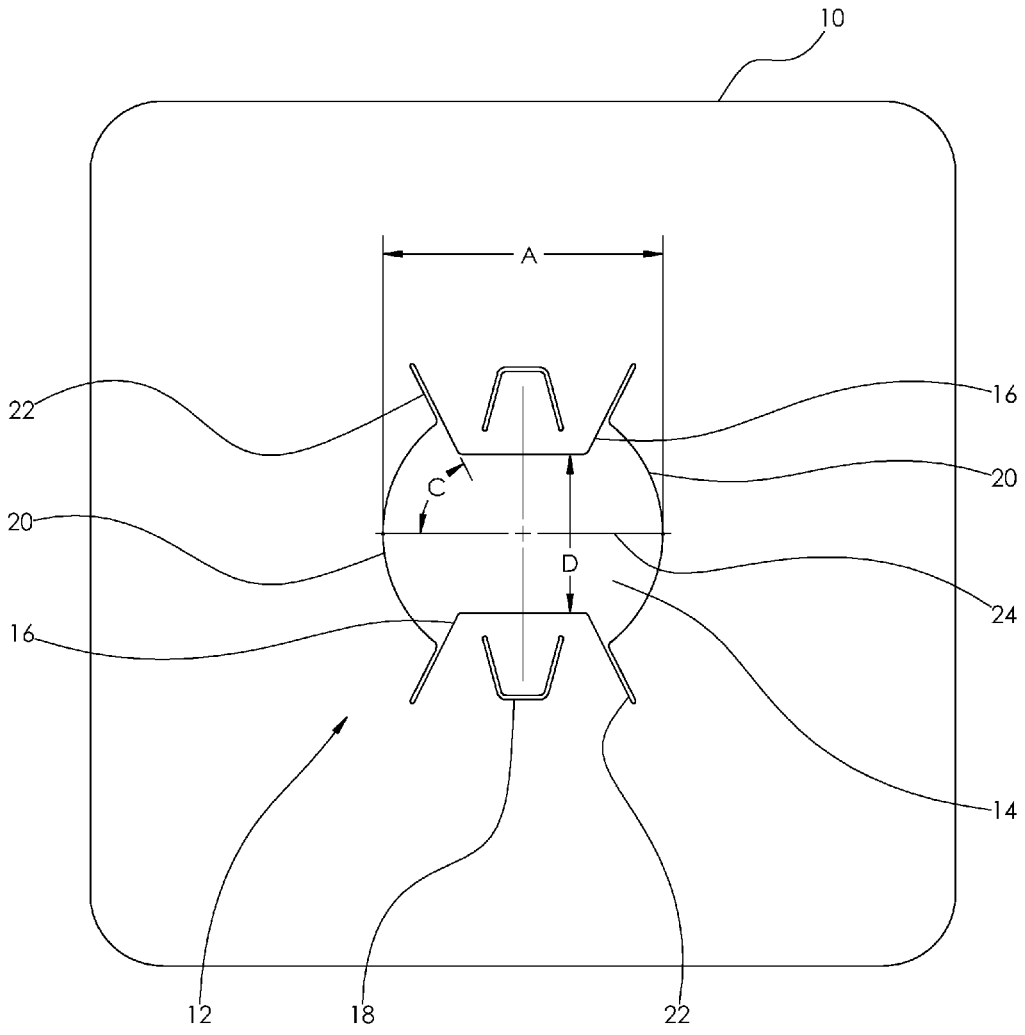
FIG. 1 is a front view of a flat sheet of a reactive target retention device in accordance with the present invention.
Figure 2:
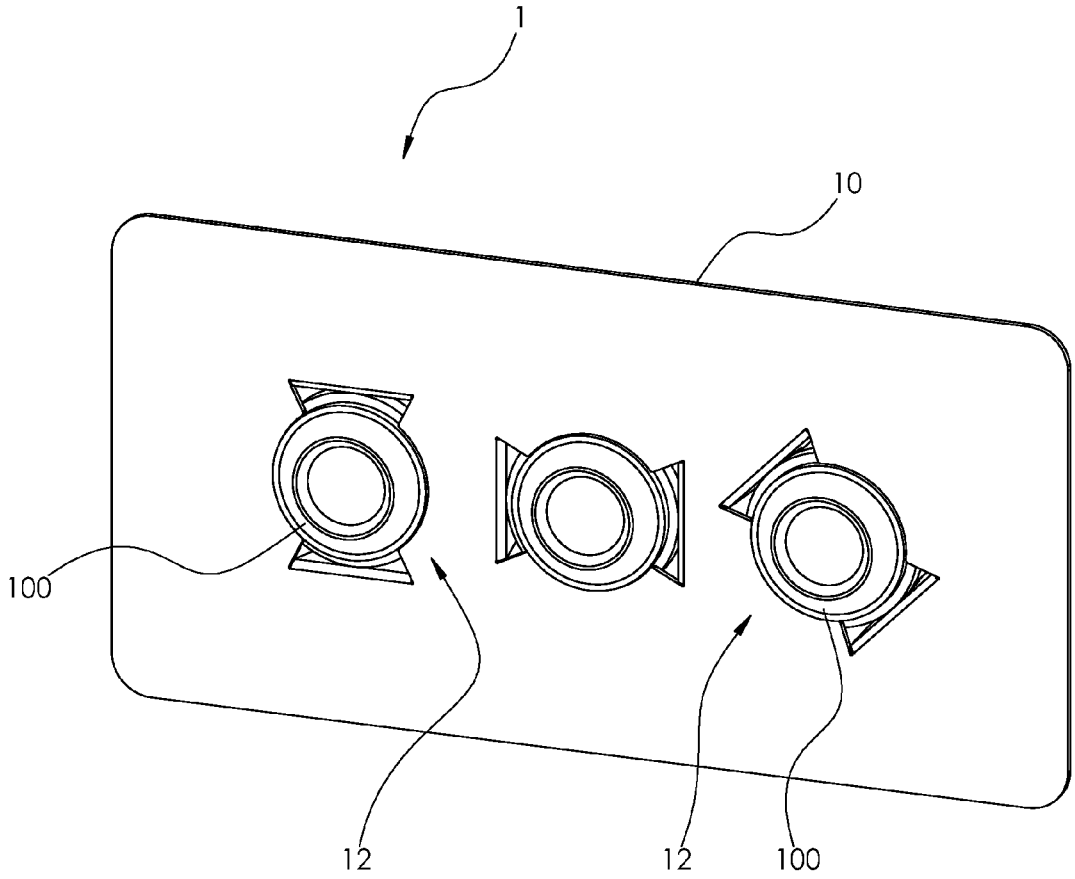
FIG. 2 is a perspective front view of a reactive target retention device with a plurality of reactive targets retained therein in accordance with the present invention.
Figure 3:
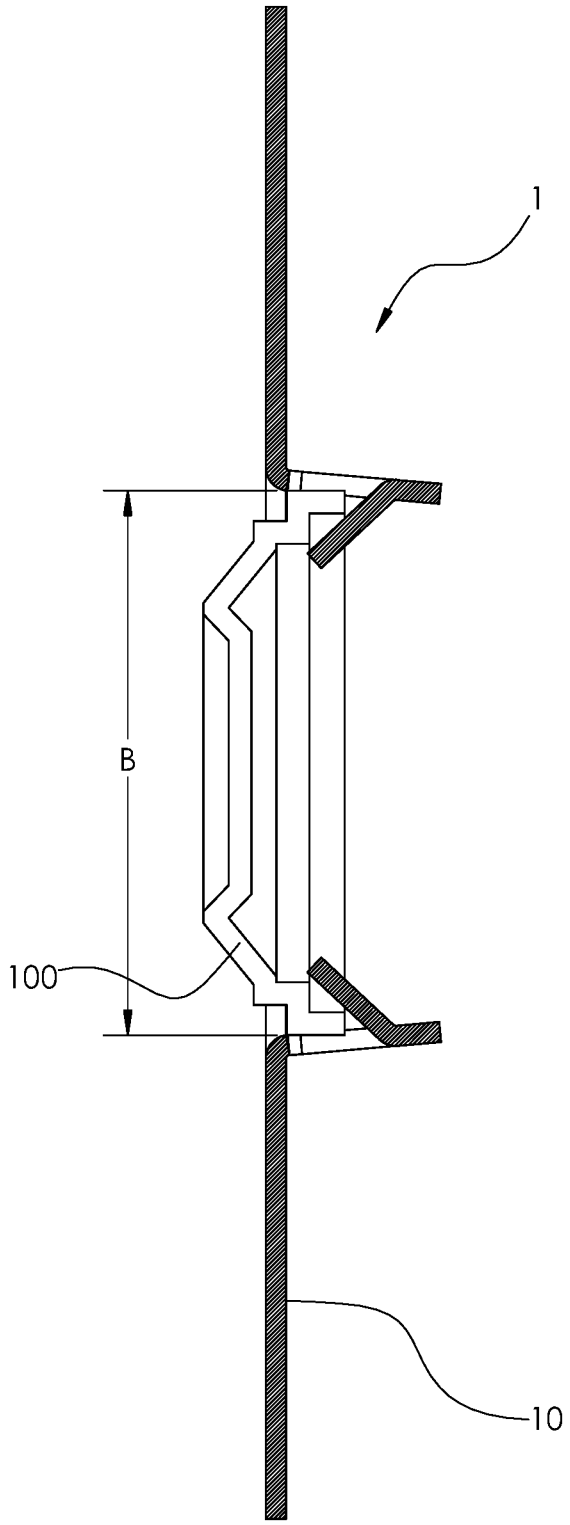
FIG. 3 is a cross sectional view of a reactive target retention device with a reactive target retained therein in accordance with the present invention.
Figure 4:
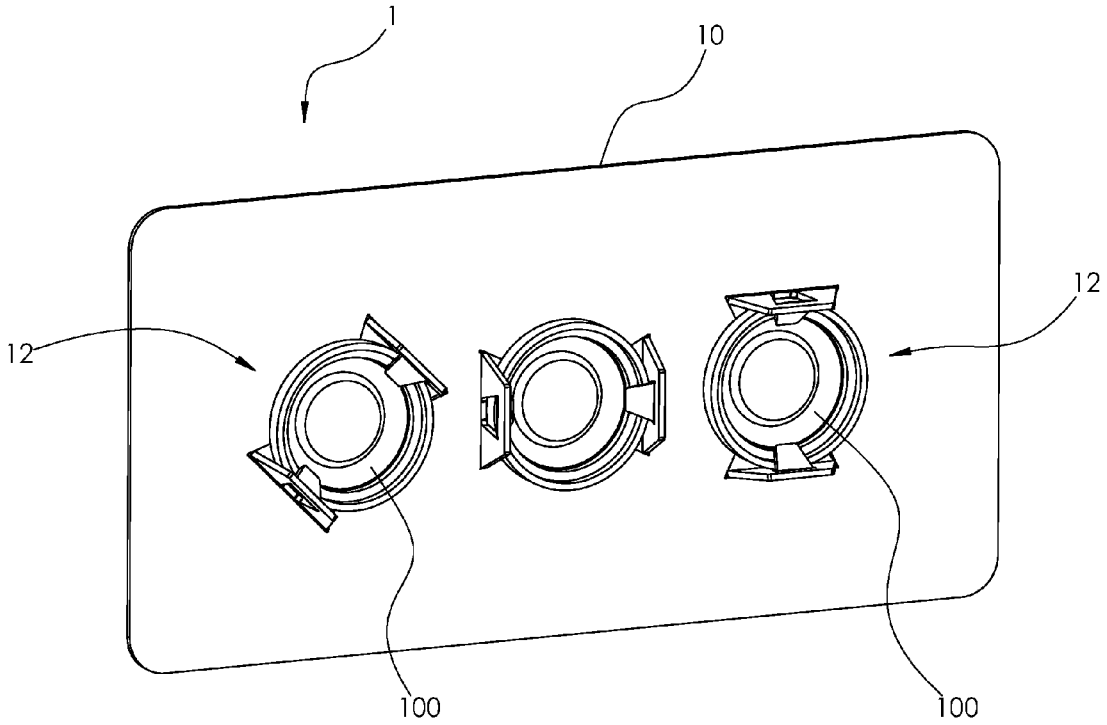
FIG. 4 is a perspective rear view of a reactive target retention device with a plurality of reactive targets retained therein in accordance with the present invention.

With reference now to the drawings, and particularly to FIG. 2, there is shown a perspective front view of a reactive target retention device 1 with a plurality of reactive targets 100 retained therein. With reference to FIGS. 1, 3 and 4, the reactive target retention device 1 preferably includes a flat sheet 10 with at least one cutout pattern 12. The flat sheet 10 is preferably fabricated from plastic, but other materials may also be used. The cutout pattern 12 includes a target opening 14, two opposing tabs 16 and an inner tab 18 is formed in each opposing tab 16. The target opening 14 includes two opposing curved portions 20. A distance "A" between the two opposing curved portions is less than an outer diameter "B" of the reactive target 100. A tab slit 22 extends from each end of each curved portions 20 at an acute angle "C" from a centerline 24 of the target opening 14. Distal ends of the two opposing tabs 16 extend into the target opening 14. Distal ends of the two opposing tabs 16 create a distance "D", which is less than a diameter "B" of the reactive target 100, when in a flat orientation. The inner tab 18 rotates in a direction opposite that of the opposing tab 16. In use, to retain the reactive target 100, both opposing tabs 16 are bent to a rear of the flat sheet 10. The reactive target 100 is inserted past the two opposing tabs 16, such that a front of the reactive target 100 contacts a rear of the flat sheet 10. The two inner tabs 18 are bent inward toward each other. The opposing tabs 16 are then bent inward toward each other. The two inner tabs 18 are then bent away from each other, such that they contact a rear of the reactive target 100. The reactive target retention device 1 will retain the reactive target 100 in any angular orientation, such as horizontal or vertical.

Figure 5:
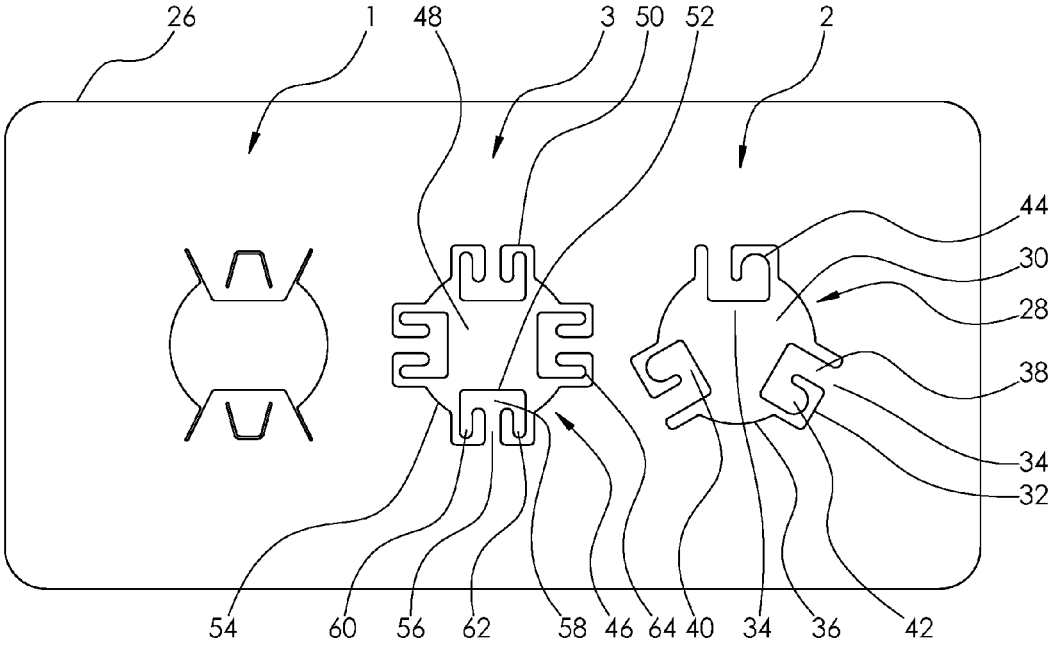
FIG. 5 is a front view of a flat sheet of a reactive target retention device having first, second and third embodiment cutout patterns in accordance with the present invention.
Figure 6:
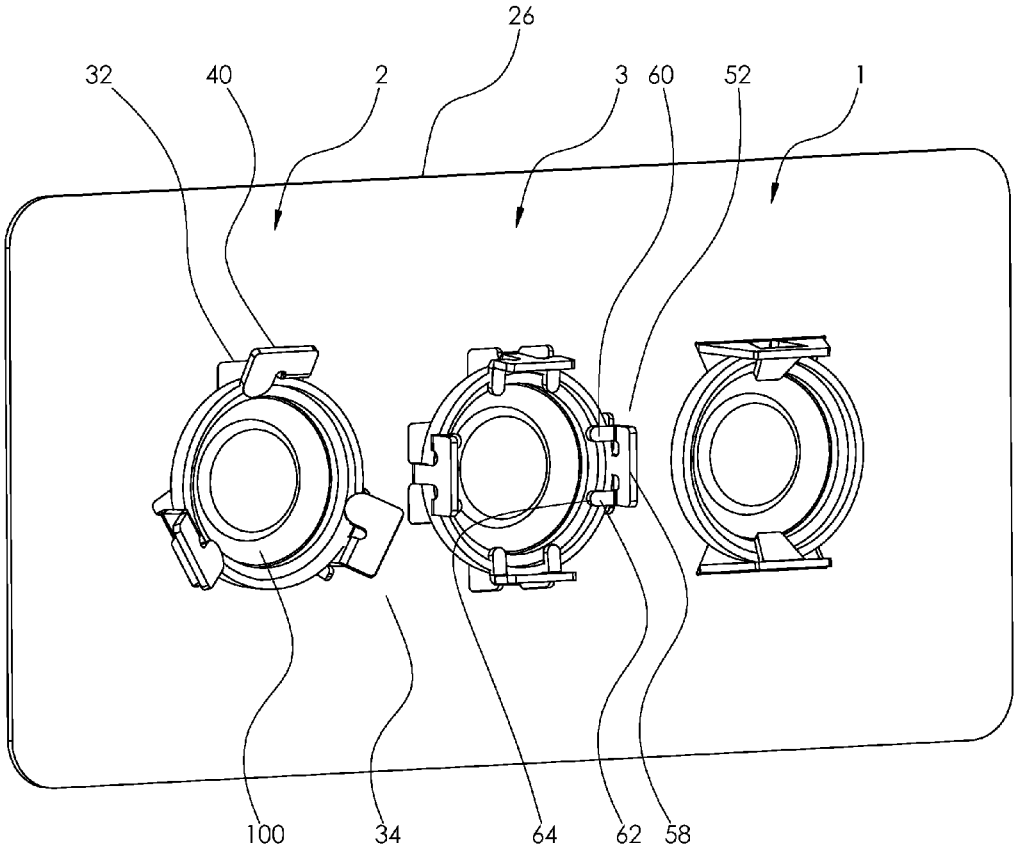
FIG. 6 is a rear perspective view of a reactive target retention device having first, second and third embodiment cutout patterns retaining reactive targets in accordance with the present invention.

With reference to FIGS. 5-6, a second embodiment of the reactive target retention device 2 preferably includes a flat sheet 26 with at least one cutout pattern 28. The flat sheet 26 is preferably fabricated from plastic, but other materials may also be used. The cutout pattern 28 includes a target opening 30, at least two partial cutouts 32 and at least two projection tabs 34. The target opening 30 includes three curved portions 36. An outer perimeter of the at least two curved portions 36 is less than an outer perimeter of the reactive target 100. Each partial cutout 32 is formed between two adjacent curved portions 36. An outer perimeter of the at least two cutouts 32 is greater than outer circumference of the reactive target 100. Each projection tab 34 includes a base portion 38, a bridge portion 40 and a retention portion 42. The base portion 38 extends from the outer perimeter of the partial cutout 32. The bridge portion 40 extends from a distal end of the base portion 38. The retention portion 42 extends outward toward the outer perimeter of the partial cutout 32 from a distal end of the bridge portion 40. An end of the retention portion 42 is preferably includes a radius 44, but the end of the retention portion 42 may also have other suitable shapes.

In use, to retain the reactive target 100, the at least two projection tabs 34 are bent to a rear of the flat sheet 26 and perpendicular thereto. The at least two bridge portions 40 are bent outward and toward the flat sheet 26 at a junction of the base portion 38. The reactive target 100 is inserted past the at least two projection tabs 34, such that a front of the reactive target 100 contacts a rear of the flat sheet 26. The at least two bridge portions 40 are then bent back toward each other to retain the reactive target 100. The reactive target device 2 will retain the reactive target 100 in any angular orientation, such as horizontal or vertical.

A third embodiment of the reactive target retention device 3 preferably includes a flat sheet 26 with at least one cutout pattern 46. The flat sheet 26 is preferably fabricated from plastic, but other materials may also be used. The cutout pattern 46 includes a target opening 48, at least two partial cutouts 50 and at least two projection tabs 52. The target opening includes at least two curved portions 54. An outer perimeter of the at least two curved portions 54 is less than an perimeter of the reactive target 100. Each partial cutout 50 is formed between two adjacent curved portions 54. An outer perimeter of the at least two cutouts 50 is greater than outer perimeter of the reactive target 100. Each projection tab 52 includes a base portion 56, a bridge portion 58, a first retention portion 60 and a second retention portion 62. The base portion 56 extends from the outer perimeter of the partial cutout 50. The bridge portion 58 extends from a distal end of the base portion 56. The first retention portion 60 extends outward toward the outer perimeter of the partial cutout 50 from a first end of the bridge portion 58. The second retention portion 62 extends outward toward the outer perimeter of the partial cutout 50 from a second end of the bridge portion 58. An end of the first and second retention portions 60, 62 preferably include a radius 64, but the end of the first and second retention portions 60, 62 may also have other suitable shapes.

In use, to retain the reactive target 100, the at least two projection tabs 52 are bent toward a rear of the flat sheet 26 and perpendicular thereto. The at least two bridge portions 58 are bent outward and toward the flat sheet 26 at a junction of the base portion 56. The reactive target 100 is inserted past the at least two projection tabs 52, such that a front of the reactive target 100 contacts a rear of the flat sheet 26. The at least two bridge portions 58 are then bent back toward each other to retain the reactive target 100, which causes the first and second retention portions 60, 62 to be bent. The reactive target retention device 3 will retain the reactive target 100 in any angular orientation, such as horizontal or vertical.

Figure 7:
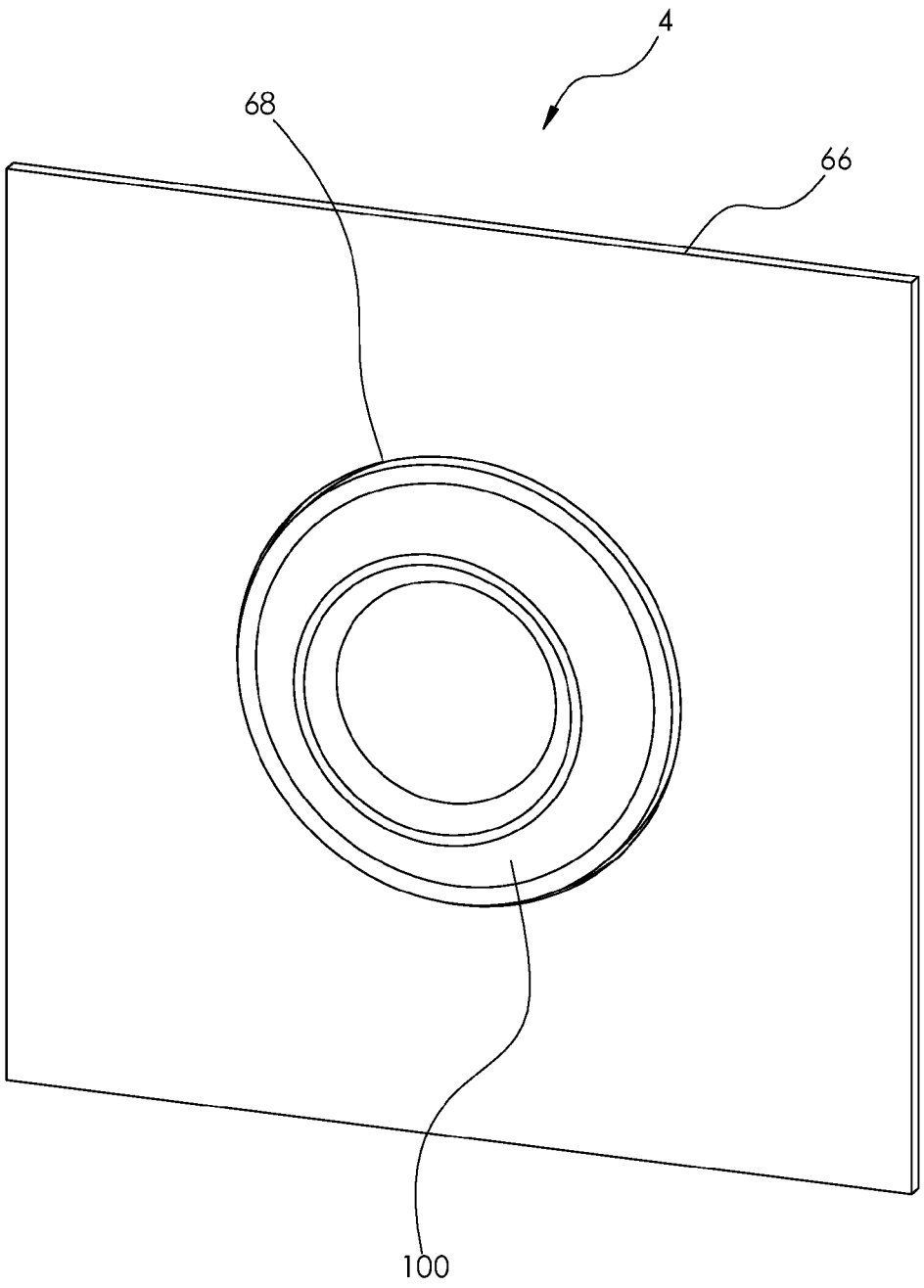
FIG. 7 is a perspective front view of a fourth embodiment of a reactive target retention device with a reactive target retained therein in accordance with the present invention.
Figure 8:
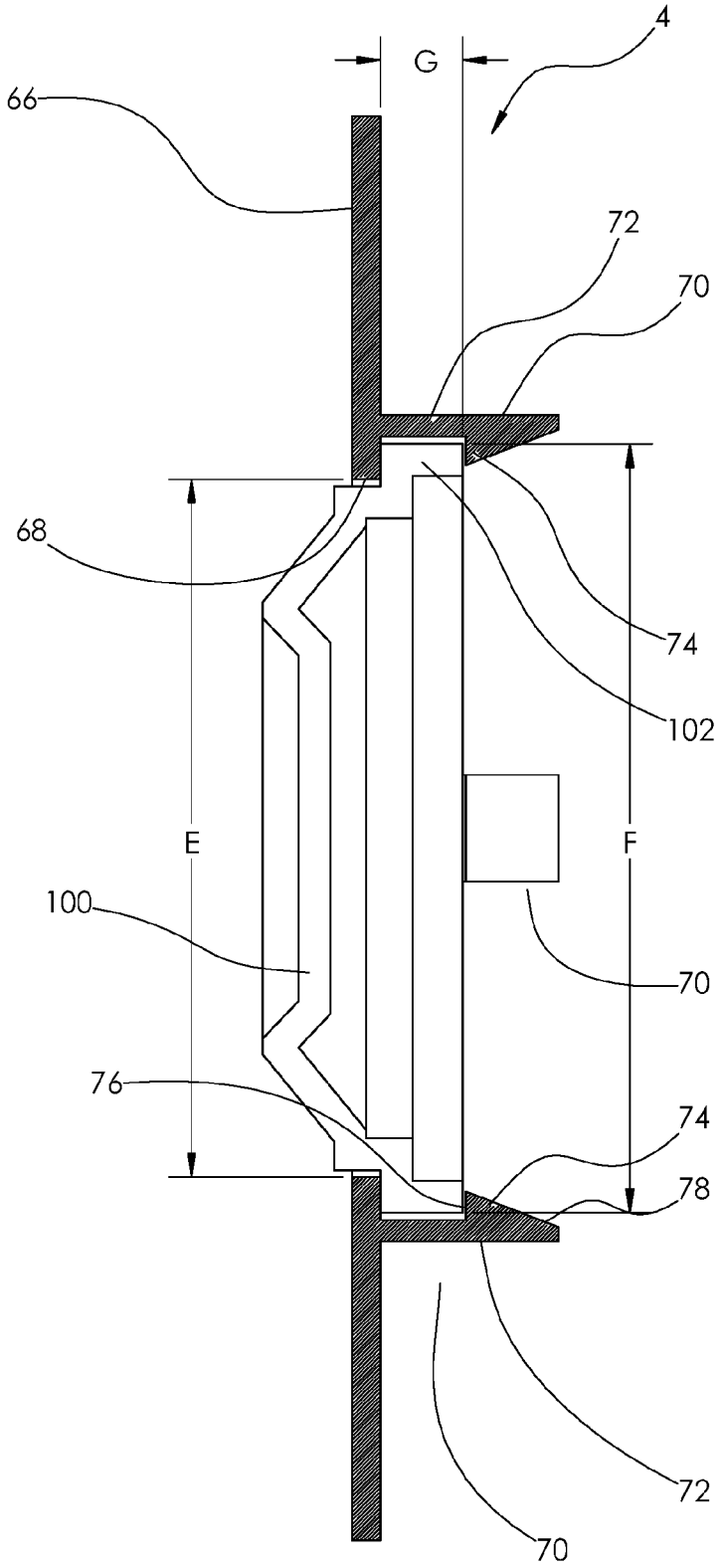
FIG. 8 is a cross sectional view of a fourth embodiment of a reactive target retention device with a reactive target retained therein in accordance with the present invention.
Figure 9:
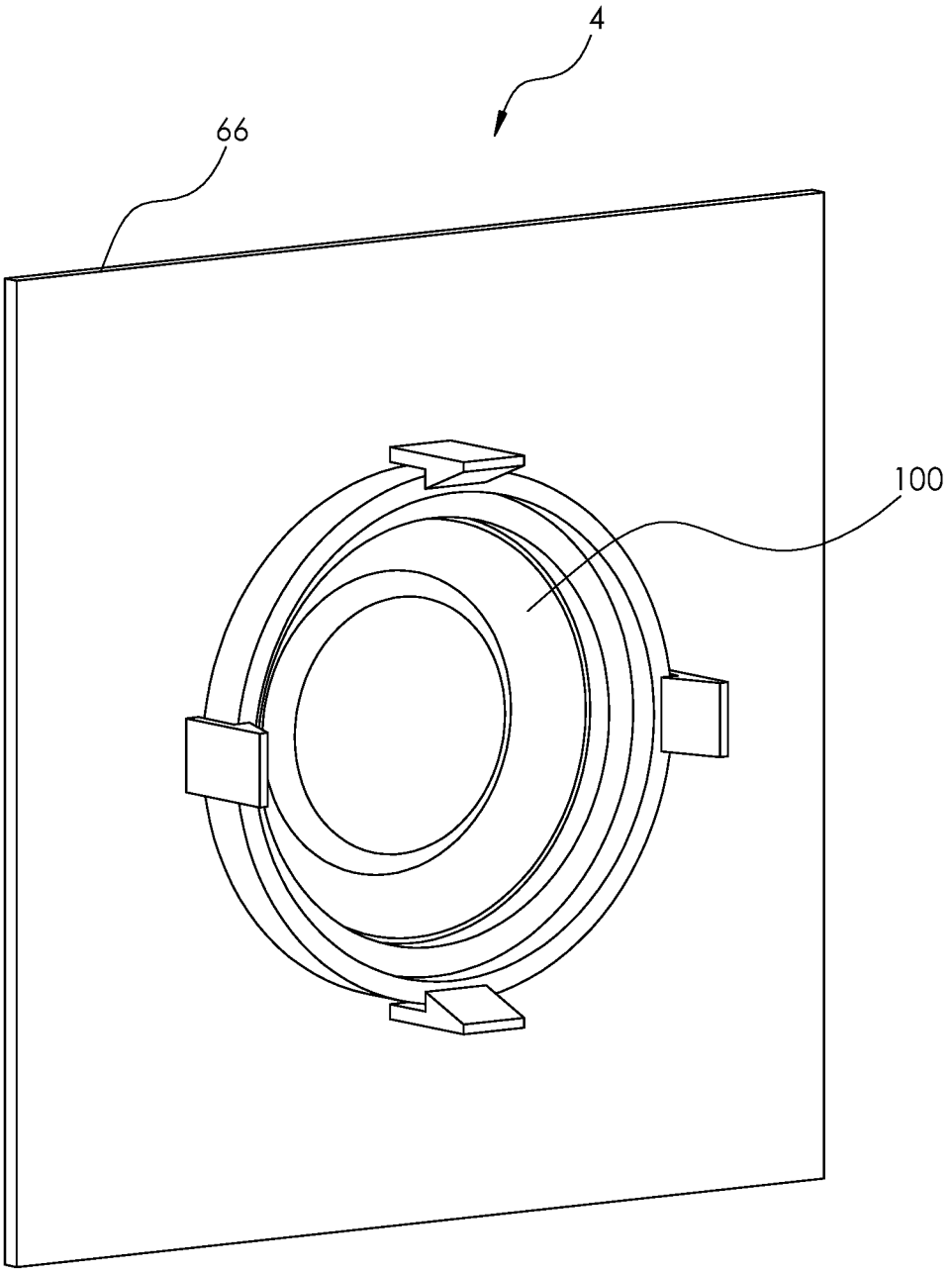
FIG. 9 is a perspective rear view of a fourth embodiment of a reactive target retention device with a reactive target retained therein in accordance with the present invention.

With reference to FIGS. 7-9, a fourth embodiment of the reactive target retention device 4 includes a plastic molded part. The plastic must have resilient properties with memory. The reactive target retention device 4 includes a flat sheet 66, a target opening 68 and at least two retention clips 70. The target opening 68 is formed through the plastic molded sheet 66 and the at least two retention clips 70 extend from a rear of the flat sheet 66 and concentric with the target opening 68. A diameter "E" of the target opening 68 is less than an outer diameter "B" of the reactive target 100. Each retention clip 70 includes a base portion 72 and a retention portion 74. A distance "F" between inside surfaces of the base portions 72 is slightly larger than an outer diameter "B" of the reactive target 100. The retention portion 74 extends from an inside surface of the base portion 72. The retention portion 74 includes a support surface 76 and a ramp surface 78. A distance "G" between the support surface 76 and the flat sheet 66 is slightly more than a thickness an outer rim 102 of the reactive target 100. The ramp surface 78 starts at a distal end of the base portion 72 and ends at an edge of the support surface 76. In use, to retain the reactive target 100, a top of the reactive target 100 is pushed into a bottom of the at least two retention clips 70. The at least two base portions 72 will flex outward to allow an outer diameter "B" of the reactive target 100 to be inserted past the at least two support surfaces 76. The at least two retention clips 70 will snap back and the reactive target 100 will be captured between a rear of the flat sheet 66 and the at least support surfaces 76.

Figure 10:
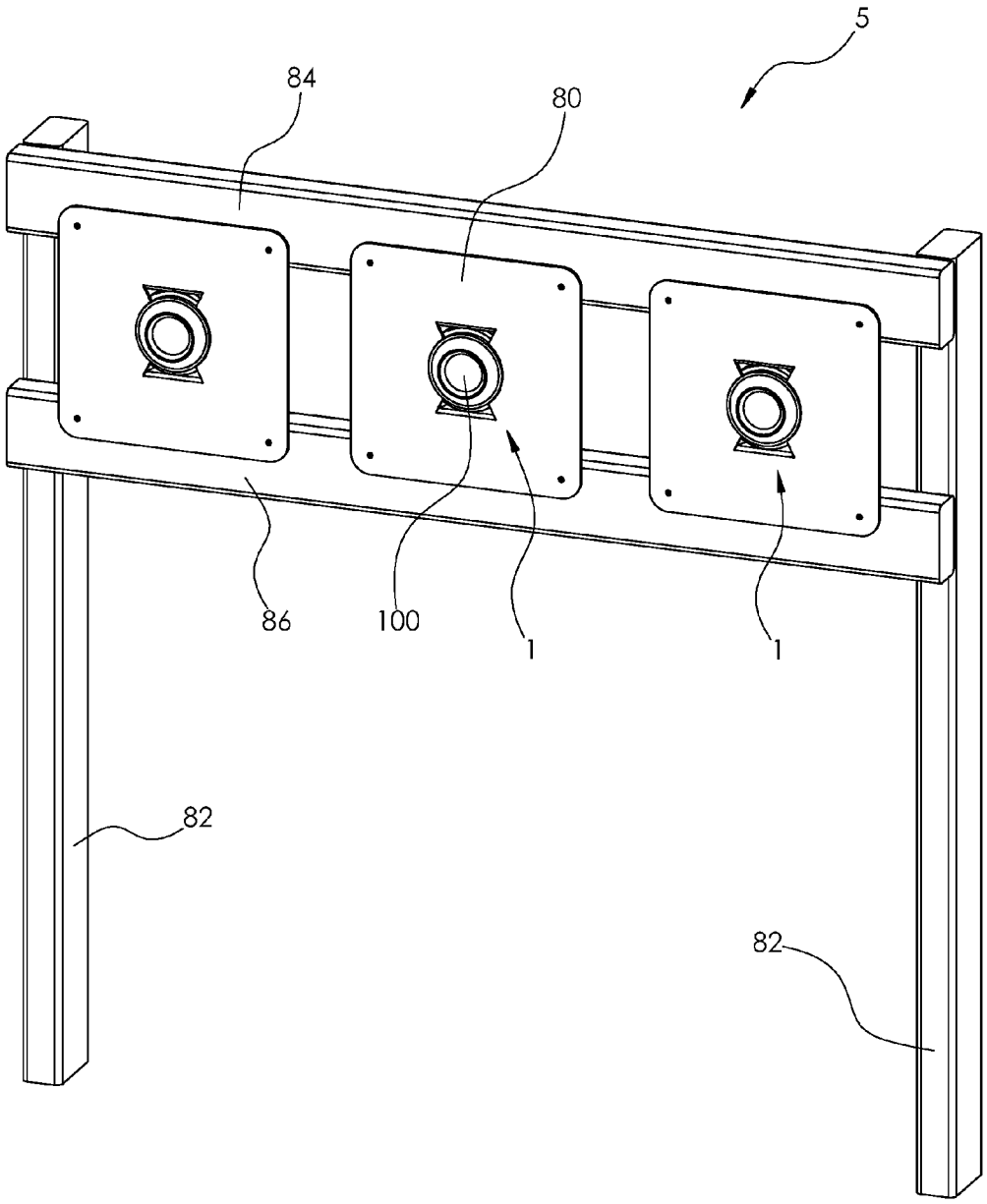
FIG. 10 is a perspective view of a target sheet support device with a plurality of reactive target retention devices retained thereby in accordance with the present invention.

With reference to FIG. 10, a flat sheet 80 may be retained in an upright position with a target sheet support device 5. The target sheet support device 5 includes a pair of post members 82 and two horizontal support members 84, 86. One end of the first horizontal support member 84 is attached to a front of the first post member 82 at a top thereof and a second end of the first horizontal support member 84 is attached to a front of the second post member 82 at a top thereof. The second horizontal support member 86 is spaced from the first horizontal support member 84 and attached to the first and second horizontal support members 82 to allow attachment of the at least one flat sheet 80 with at least one reactive target 100 retained thereby. The pair of post members 82 are pounded into the ground.

Figure 11:
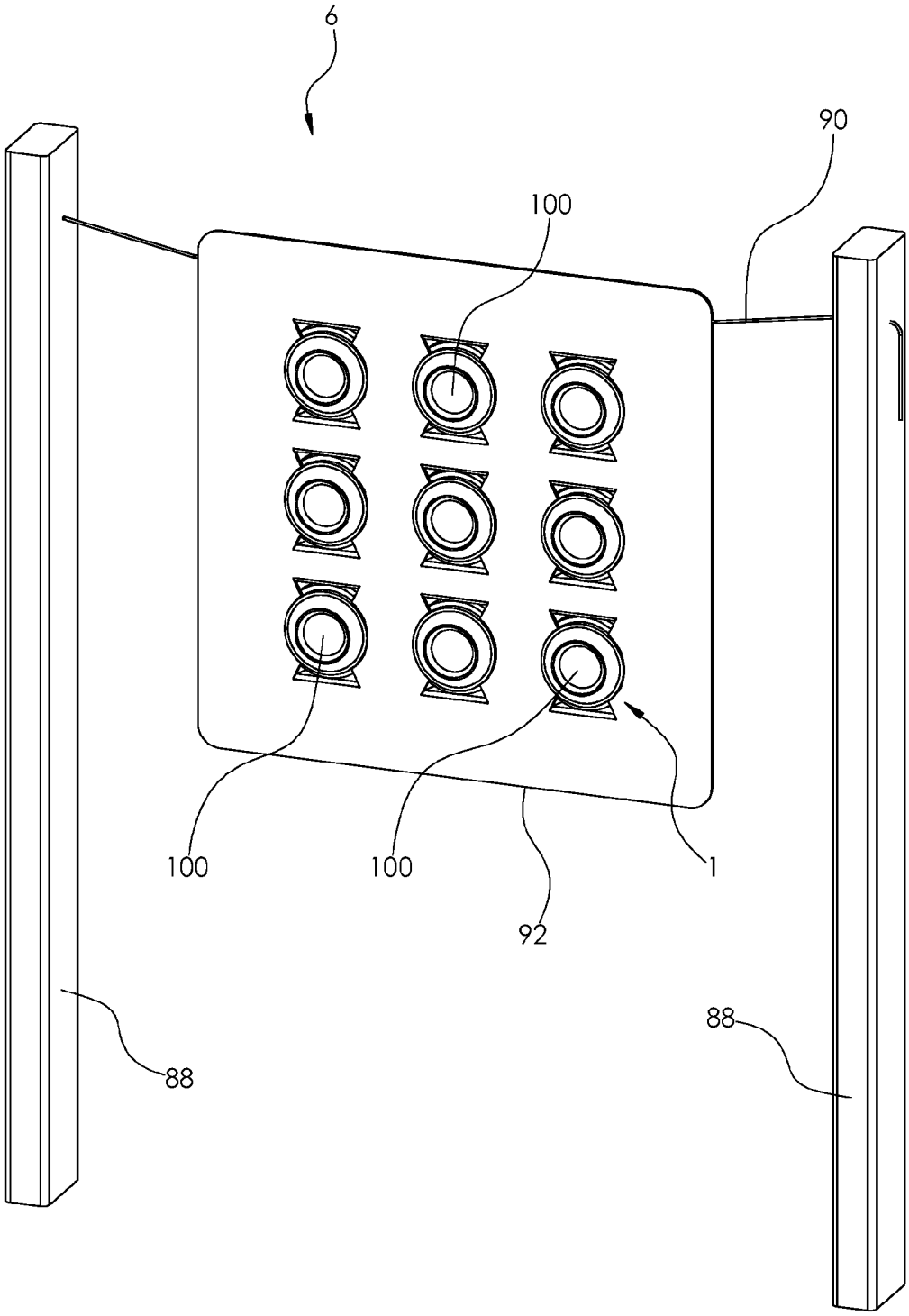
FIG. 11 is a perspective view of a second embodiment of a target sheet support device with a reactive target retention device retained thereby in accordance with the present invention.

With reference to FIG. 11, a second embodiment of the target sheet support device 6 includes a pair of post members 88 and at least one horizontal support wire 90. One end of the horizontal support wire 90 is attached to the first post member 88 and a second end of the horizontal support wire is attached to the second post member 88. A flat sheet 92 includes at least two hooks (not shown) or the like to hang on the horizontal support wire 90. A plurality of reactive targets 100 are retained in the flat sheet 92. The pair of post members 88 are pounded into the ground.

Figure 12:
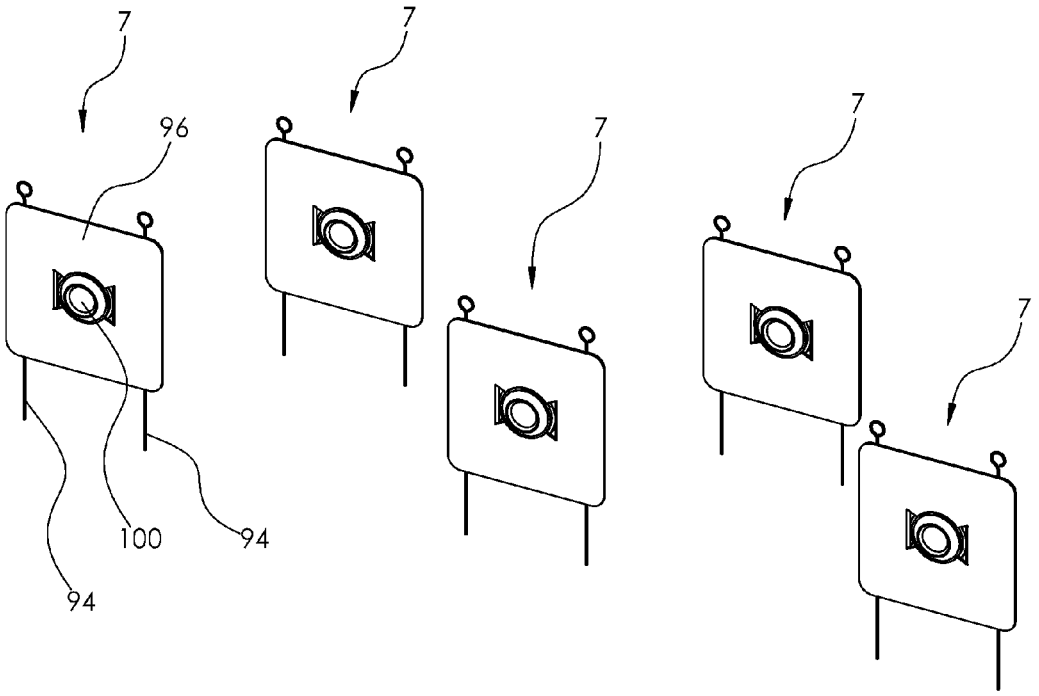
FIG. 12 is a perspective view of a plurality of third embodiment target sheet support devices attached to a plurality of reactive target retention devices in accordance with the present invention.

With reference to FIG. 12, a third embodiment of the target sheet support device 7 includes a pair of support pins 94. The support pins 94 are attached to opposing ends of a flat sheet 96 with any suitable method. The reactive target 100 is retained in each flat sheet 96. The support pins 94 are pounded into the ground.

Figure 13:
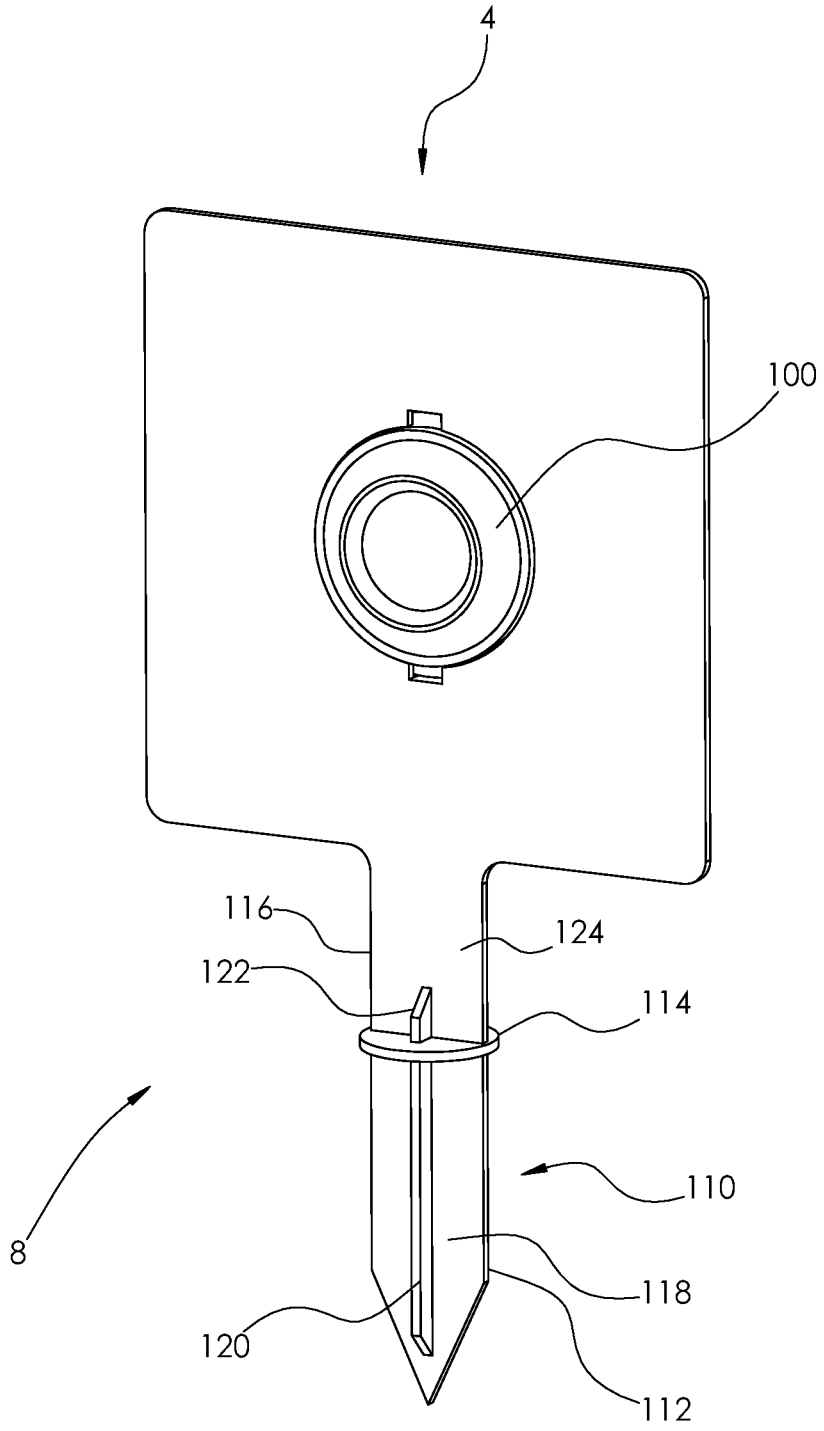
FIG. 13 is a perspective view of a fourth embodiment of a target sheet support device having at least one reactive target retention device retained thereby in accordance with the present invention.

With reference to FIG. 13, a fourth embodiment of the target sheet support device 8 includes the fourth embodiment of the reactive target retention device 4 and a support post 110. The support post 110 includes an insertion portion 112, a ring portion 114 and a support portion 116. The insertion portion 112 extends downward from a bottom of the ring portion 114 and the support portion 116 extends upward from a top of the ring portion 114. The insertion portion 112 preferably includes a base insertion portion 118 and two opposed stiffening ribs 120 extending from opposing sides of the base insertion portion 118. The support portion 116 includes two upper opposed stiffening ribs 122 extending outward from an upper base portion 124 and upward from a top of the ring portion 114.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A reactive target retention device comprising:

a flat sheet having at least one cutout pattern, each one of said at least one cutout pattern includes a target opening, two opposing tabs, an inner tab is formed in each opposing tab, a perimeter of said inner tab is contained within a perimeter of one of said two opposing tabs, said target opening includes two opposing substantially curved portions, a distance between said two opposing tabs is less than a distance between said two opposing substantially curved portions, one of said two opposing substantially curved portions is located between each side of said pair of opposing tabs, wherein said opposing tabs are bent relative to said flat sheet, said inner tab is bent relative to one of said two opposing tabs to retain the reactive target.

2. The reactive target retention device of claim 1 wherein: said flat sheet is fabricated from a plastic sheet.

3. The reactive target retention device of claim 1, further comprising:

a target sheet support device includes a flat sheet and a pair of support pins, said pair of support pins are attached to opposing ends of said flat sheet.

4. A reactive target retention device comprising:

a flat sheet having at least one cutout pattern, each one of said at least one cutout pattern includes a target opening, two opposing tabs, an inner tab is formed in each opposing tab, a perimeter of said inner tab is contained within a perimeter of one of said two opposing tabs, said target opening includes two opposing substantially curved portions, a distance between said two opposing tabs is less than a distance between said two opposing substantially curved portions, one of said two opposing substantially curved portions is located between each side of said pair of opposing tabs, wherein said opposing tabs are bent relative to said flat sheet, said inner tab is bent relative to one of said two opposing tabs to retain the reactive target.

5. The reactive target retention device of claim 4 wherein: said flat sheet is fabricated from a plastic sheet.

6. The reactive target retention device of claim 4, further comprising:

a target sheet support device includes a flat sheet and a pair of support pins, said pair of support pins are attached to opposing ends of said flat sheet.

7. A reactive target retention device comprising:

a flat sheet having at least one cutout pattern, each one of said at least one cutout pattern includes a target opening, two opposing tabs, an inner tab is formed in each opposing tab, a perimeter of said inner tab is contained within a perimeter of one of said two opposing tabs, said target opening includes two opposing substantially curved portions, a distance between said two opposing tabs is less than a distance between said two opposing substantially curved portions, one of said two opposing substantially curved portions is located between each side of said pair of opposing tabs.

8. The reactive target retention device of claim 7 wherein: said flat sheet is fabricated from a plastic sheet.

9. The reactive target retention device of claim 7, further comprising:

a target sheet support device includes a flat sheet and a pair of support pins, said pair of support pins are attached to opposing ends of said flat sheet.

* * * * *